US006034487A

United States Patent [19]

Yamashita et al.

[11] Patent Number: 6,034,487

[45] Date of Patent: Mar. 7, 2000

[54] LIGHTING CIRCUIT FOR DISCHARGE LAMP

[75] Inventors: Masayasu Yamashita; Atsushi Toda, both of Shimizu, Japan

[73] Assignee: Koito Manufacturing Co., Ltd., Tokyo, Japan

[21] Appl. No.: 09/140,773

[22] Filed: Aug. 26, 1998

[30] Foreign Application Priority Data

Sep. 25, 1997 [JP] Japan ..... 9-259705

[51] Int. Cl.[7] ..... H05B 37/00

[52] U.S. Cl. ..... 315/244; 315/126; 315/209 R; 315/307; 315/DIG. 5; 315/DIG. 7

[58] Field of Search ..... 315/307, 308, 315/291, 224, 127, 126, 82, DIG. 5, DIG. 7, 209 R, 244

[56] References Cited

U.S. PATENT DOCUMENTS

| | | | |
|---|---|---|---|
| 5,068,570 | 11/1991 | Oda et al. | 315/128 |
| 5,140,229 | 8/1992 | Yagi et al. | 315/307 |
| 5,142,203 | 8/1992 | Oda et al. | 315/308 |
| 5,151,631 | 9/1992 | Oda et al. | 315/127 |
| 5,212,428 | 5/1993 | Sasaki et al. | 315/308 |
| 5,295,036 | 3/1994 | Yagi et al. | 361/79 |
| 5,422,548 | 6/1995 | Yamashita et al. | 315/308 |
| 5,428,267 | 6/1995 | Peil | 315/224 |
| 5,449,973 | 9/1995 | Yamashita et al. | 315/82 |
| 5,485,059 | 1/1996 | Yamashita et al. | 315/307 |
| 5,486,740 | 1/1996 | Yamashita et al. | 315/308 |
| 5,514,935 | 5/1996 | Oda et al. | 315/82 |
| 5,519,289 | 5/1996 | Katyl et al. | 315/224 |
| 5,572,094 | 11/1996 | Yamashita et al. | 315/308 |
| 5,629,588 | 5/1997 | Oda et al. | 315/308 |
| 5,663,613 | 9/1997 | Yamashita et al. | 315/308 |
| 5,705,898 | 1/1998 | Yamashita et al. | 315/308 |

*Primary Examiner*—Haissa Philogene
*Attorney, Agent, or Firm*—Sughrue, Mion, Zinn, Macpeak & Seas, PLLC

[57] ABSTRACT

A lighting circuit for a discharge lamp comprises a DC power supply circuit having a coil and a capacitor at its input stage, a DC-AC converter for converting the output voltage of the DC power supply circuit to an AC voltage and supplying the AC voltage to a discharge lamp, ignition means for generating an ignition pulse to the discharge lamp, and control means for performing variable control on the output voltage of the DC power supply circuit 3. The control means 6 performs such a boosting operation as to boost the output voltage of the DC power supply circuit 3 to a predetermined voltage under a loadless condition while the ignition pulse generated by the ignition means 5 is supplied to the discharge lamp 11 to thereby light the discharge lamp 11. During the boosting operation, the ignition means 5 applies the ignition pulse to the discharge lamp 11, lighting the discharge lamp.

21 Claims, 9 Drawing Sheets

LIGHTING CIRCUIT FOR DISCHARGE LAMP

BACKGROUND OF THE INVENTION

1. Field of the Invention

The present invention relates to a technique which prevents deterioration of the lighting characteristic of a discharge lamp from being caused by a variation in supply voltage, thereby ensuring smooth lighting of the discharge lamp.

2. Description of the Related Art

A known lighting circuit for discharge lamps including a metal halide lamp comprises, for example, a DC power supply circuit, which boosts the input voltage from a DC power supply to a predetermined voltage, a DC-AC converter, which converts the DC voltage output from the DC power supply circuit to an AC voltage and supplies the latter voltage to a discharge lamp, and an igniter circuit which generates a high-voltage ignition pulse at the time of igniting the discharge lamp.

The conventional lighting circuit however has such a shortcoming that when the supply voltage varies (e.g., when the supply voltage falls abnormally), the lighting characteristic of a discharge lamp is so deteriorated as to make it difficult to light the discharge lamp.

Accordingly, it is an object of the present invention to permit a discharge lamp to have an excellent lighting characteristic even when the supply voltage varies.

SUMMARY OF THE INVENTION

To achieve the object, a lighting circuit for a discharge lamp according to this invention comprises a DC power supply circuit having a coil and a capacitor at an input stage; an DC-AC converter for converting an output voltage of the DC power supply circuit to an AC voltage and supplying the AC voltage to a discharge lamp; ignition means for generating an ignition pulse to the discharge lamp; and control means for performing variable control on the output voltage of the DC power supply circuit in such a way as to carry out a boosting operation to boost the output voltage of the DC power supply circuit to a predetermined voltage under a loadless condition while the ignition pulse generated by the ignition means is supplied to the discharge lamp to thereby light the discharge lamp, whereby while the control means is performing the boosting operation on the DC power supply circuit, or during a period from a point at which the coil and the capacitor provided at the input stage of the DC power supply circuit start resonating after execution of the boosting operation on the DC power supply circuit by the control means, to a point at which a voltage at a node between the coil and the capacitor reaches a peak, the ignition means applies the ignition pulse to the discharge lamp to light the discharge lamp.

According to this invention, the timing for applying the ignition pulse to a discharge lamp is specified and the resonance of the coil and capacitor, provided at the input stage of the DC power supply circuit, can suppress a drastic fall of the input voltage to the DC power supply circuit at the instant the discharge lamp is lit.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings.

DETAILED DESCRIPTION OF THE PREFERRED EMBODIMENT

Figure 1:
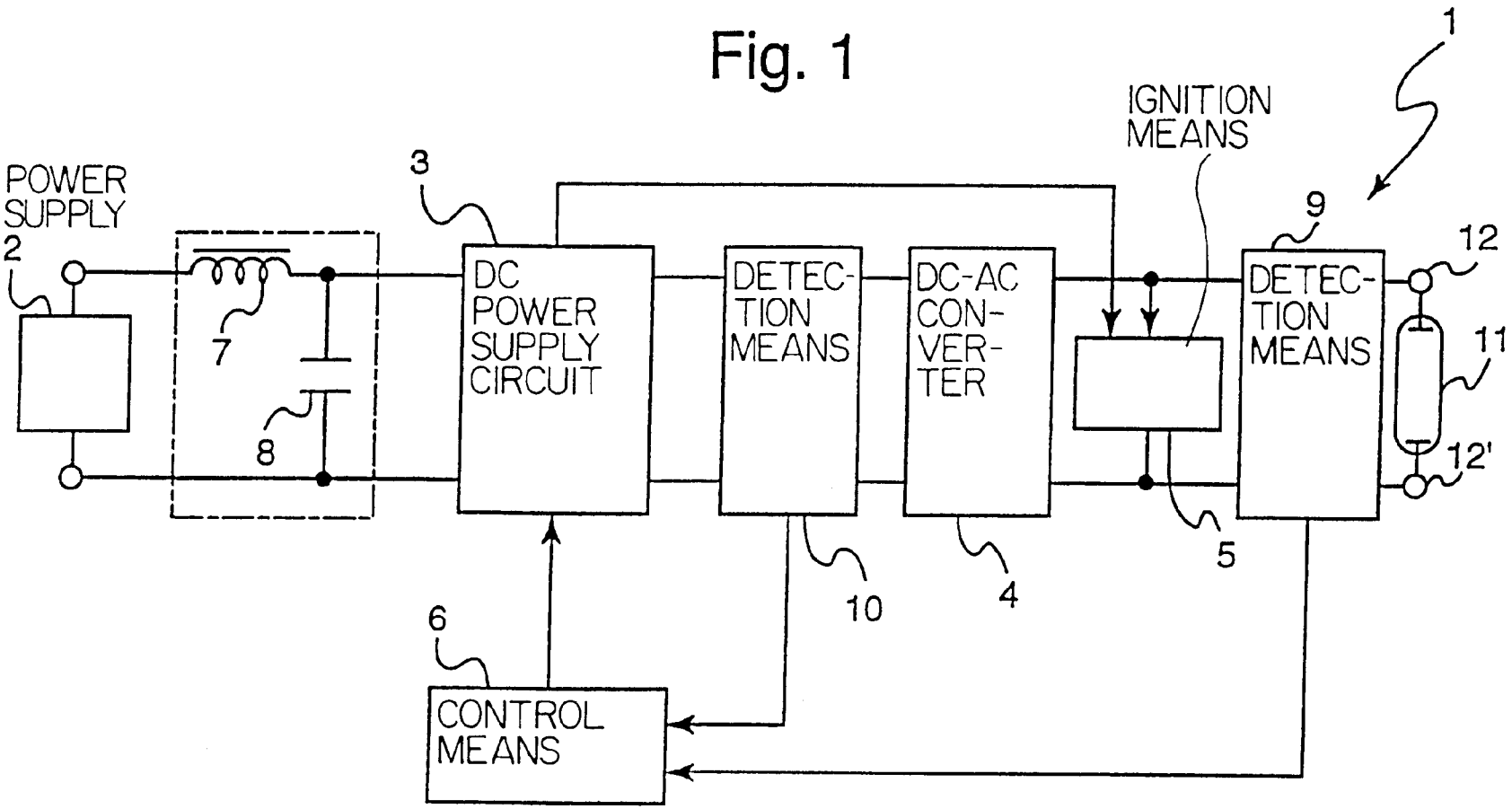
FIG. 1 is a circuit block diagram for explaining the basic constitution of a lighting circuit according to this invention.

FIG. 1 shows the basic constitution of a lighting circuit 1 according to this invention. This lighting circuit 1 comprises a power supply 2, a DC power supply circuit 3, a DC-AC converter 4, ignition means 5 and control means 6.

An input voltage supplied from the power supply 2 is input to the DC power supply circuit 3 via a coil 7 and a capacitor 8, which are provided at the input stage of the DC power supply circuit 3. This input voltage is boosted by this circuit 3. The DC power supply circuit 3 may take the constitution of a DC-DC converter (or a switching regulator) of various types, such as a chopper type, flyback type and forward type.

The DC-AC converter 4, located at the subsequent stage of the DC power supply circuit 3, converts the output voltage of the DC power supply circuit 3 to an AC voltage (of a rectangular waveform, a sine waveform or the like) and applies the AC voltage to a discharge lamp 11. One example of the DC-AC converter 4 is a bridge type circuit which uses plural pairs of semiconductor switch elements.

The ignition means 5 generates a high-voltage ignition pulse and applies the pulse to the discharge lamp 11. For example, the ignition means 5 has a switch element, a capacitor and a pulse transformer. The capacitor is charged with the voltage from the DC power supply circuit 3 or the DC-AC converter 4. When the terminal voltage of the capacitor reaches a predetermined value, the switch element operates to generate and apply the ignition pulse to the discharge lamp 11.

The control means 6 performs variable control on the output voltage of the DC power supply circuit 3 in accordance with a detection signal representing the lamp voltage or lamp current of the discharge lamp 11 that has been detected by detection means 9, or its equivalent signal which is a detection signal representing the output voltage or output current of the DC power supply circuit 3 that has been detected by detection means 10. This control means 6 can employ a known control system like PWM (Pulse Width Modulation) control.

During the period from the point at which the ignition pulse generated by the ignition means 5 is supplied to the discharge lamp 11 and to the point at which the discharge lamp 11 is lit, the control means 6 executes control to boost the output voltage of the DC power supply circuit 3 to a predetermined voltage (open voltage) under a loadless condition.

The discharge lamp 11 is connected to output terminals 12 and 12' of the lighting circuit 1.

Figure 2:
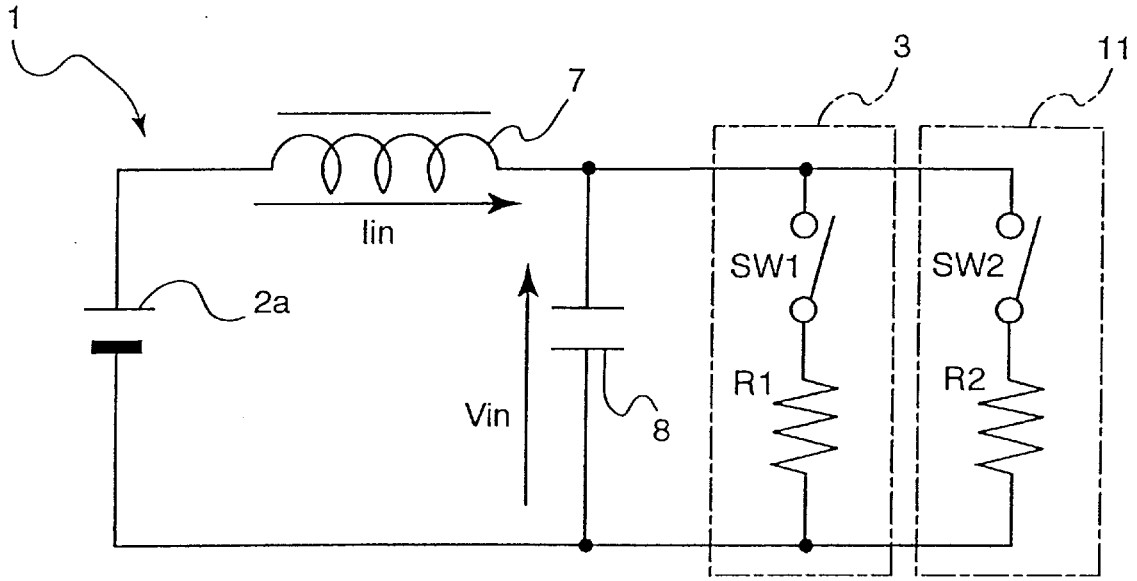
FIG. 2 is an equivalent circuit diagram showing the constitution of the essential portion.

FIG. 2 shows the essential portion of the lighting circuit 1 in the form of an equivalent circuit. The boosting operation of the DC power supply circuit 3 is represented by the ON/OFF status of a switch SW1, while the lighting status of the discharge lamp 11 is indicated by the ON/OFF status of a switch SW2. The coil 7 has one end connected to the positive polarity of a constant voltage source 2*a* and the other end connected via a capacitor 8 to the negative polarity of the constant voltage source 2*a*. The DC power supply circuit 3, which is expressed by a series circuit of the switch SW1 and a resistor R1, is provided in parallel to the capacitor 8 at the subsequent stage thereof. The discharge lamp 11, which is expressed by a series circuit of the switch SW2 and a resistor R2, is provided at the subsequent stage of the DC power supply circuit 3.

The ON status of the switch SW1 means that the output voltage of the DC power supply circuit 3 has not reached the open voltage yet, and the OFF status of the switch SW1 means that the output voltage of the DC power supply circuit 3 has reached the open voltage due to the boosting operation. The ON status of the switch SW2 means that the discharge lamp 11 is lit while the OFF status of the switch SW2 means that the discharge lamp 11 is not lit yet (which is equivalent to the aforementioned loadless condition).

Figure 3:
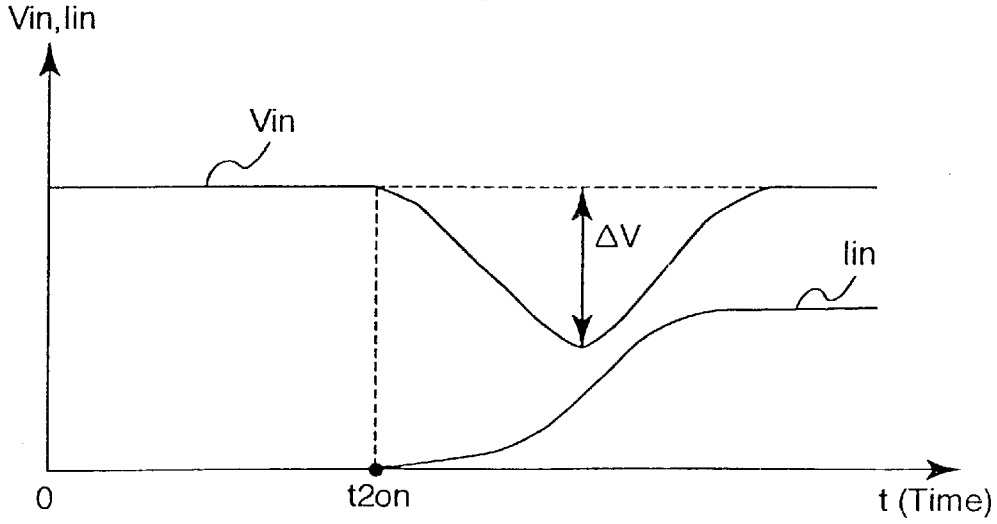
FIG. 3 is a schematic graph for explaining a drop of the input voltage.

According to this invention, at the time the ignition pulse generated by the ignition means 5 is applied to the discharge lamp 11 to light the lamp 11, the resonance of the coil 7 and the capacitor 8 is used to suppress a variation in the input voltage to the lighting circuit 1. When such resonance is not used, when the discharge lamp 11 is lit at a time t=t2on, the input current (Iin) to the DC power supply circuit 3 rises from zero and the input voltage (Vin) to the DC power supply circuit 3 falls, as shown in FIG. 3. As the then-voltage drop, ΔV, is large, the lighting status of the discharge lamp 11 may become unstable.

By contrast, the resonance of the coil 7 and the capacitor 8 can provide the following advantages.

(I) The amount of the drop of the input voltage the instant the discharge lamp is lit can be reduced.

(II) The input voltage upon lighting of the discharge lamp after the output voltage of the DC power supply circuit reaches the open voltage increases temporarily.

Figure 4:
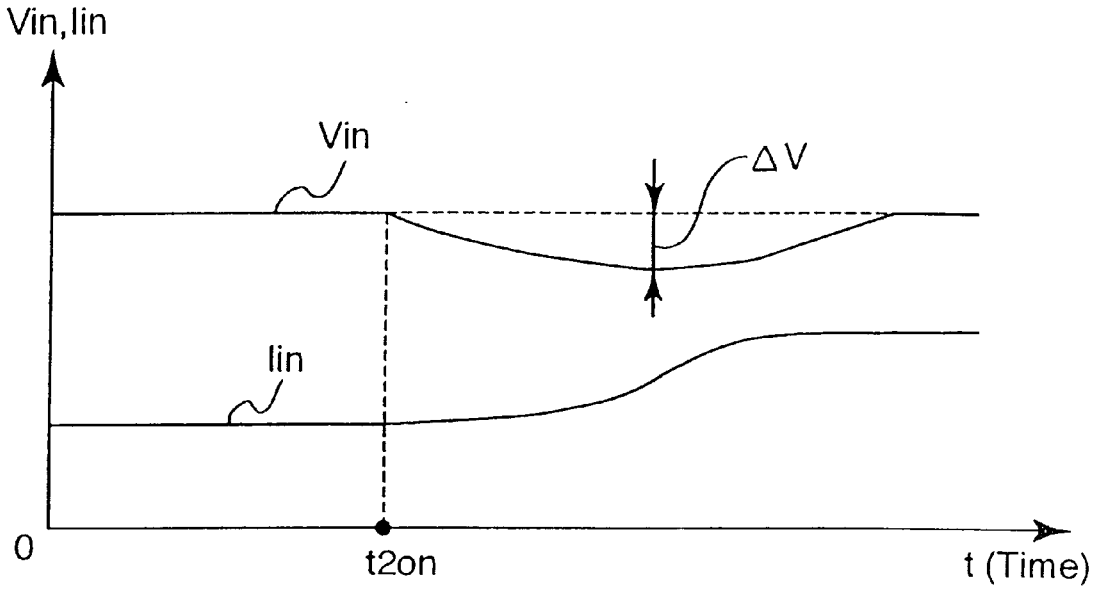
FIG. 4 is a schematic graph showing variations in input voltage and input current when a discharge lamp is lit during the boosting operation on a DC power supply circuit and for explaining the resonance effect together with FIG. 5.

With regard to the advantage described in (I), when the switch SW1 is on (during the boosting operation) and the switch SW2 is on in FIG. 2, i.e., when the discharge lamp 11 is lit, the input current Iin (the current flowing across the coil 7) which has been constant gradually increases from the time t=t2on and the input voltage Vin (the terminal voltage of the capacitor 8) drops from the time t, as shown in FIG. 4. Since the voltage drop ΔV is small, the variation amount is suppressed.

Figure 5:
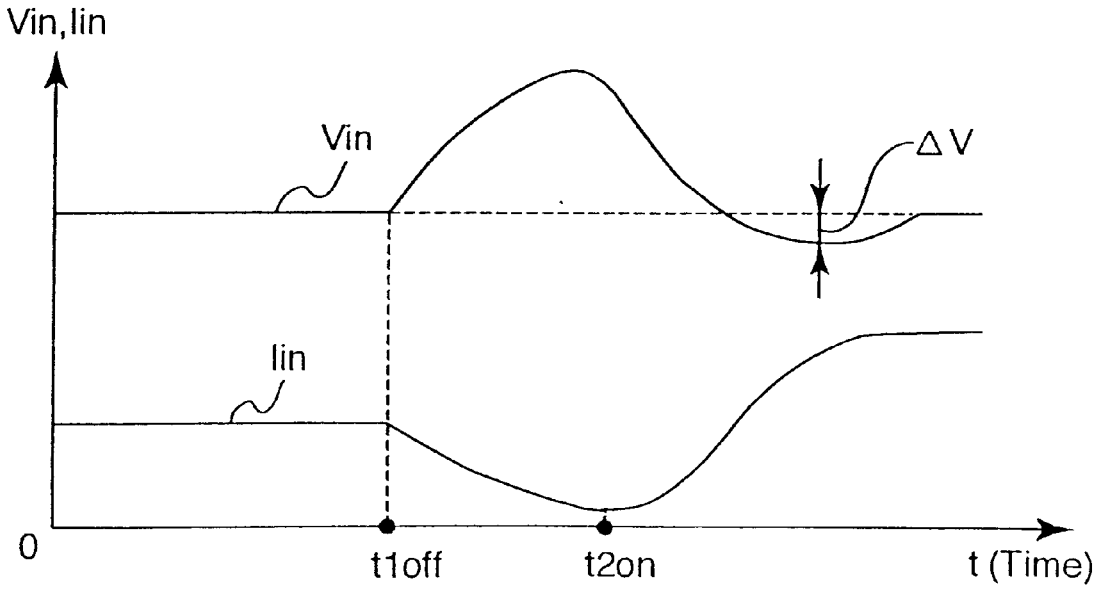
FIG. 5 is a schematic graph illustrating variations in input voltage and input current when a discharge lamp is lit after the output voltage of the DC power supply circuit is boosted to a predetermined voltage.

As regards the advantage described in (II), when, after the switch SW1 becomes off, the switch SW2 becomes on in FIG. 2, lighting the discharge lamp 11, the input voltage Vin temporarily rises as shown in FIG. 5. Specifically, the input current Iin starts decreasing, and the input voltage Vin starts rising, from the time t=t1off in FIG. 5. While the input voltage Vin reaches a peak value, the discharge lamp 11 is lit, and the input current Iin rises from the bottom value and stays at a constant value. In this case, the voltage drop ΔV with reference to the input voltage Vin before t=t1off is small.

In this invention, regarding the advantage (I), the timing at which the ignition means 5 applies the ignition pulse to the discharge lamp 11 is specified in such a way that the pulse application is carried out while the boosting operation on the DC power supply circuit 3 is conducted by the control means 6. Regarding the advantage of (II), the pulse applying timing is specified in such a manner that after the boosting operation on the DC power supply circuit 3 by the control means 6, the ignition means 5 applies the ignition pulse to the discharge lamp 11 during a period from the point when the voltage at the node between the coil 7 and the capacitor 8 reaches a peak to the point when the resonance of the coil 7 and the capacitor 8, provided at the input stage of the DC power supply circuit 3, starts.

This timing control suppresses the amount of a reduction in the input voltage, preventing the lighting characteristic of the discharge lamp from being degraded by the dropped input voltage. It is therefore possible to decrease the frequency of occurrence of lighting failures or the like.

The timing for applying the ignition pulse is controlled by properly setting the constants of the circuit elements of the ignition means, or by separately providing a timing controller with respect to the ignition means.

To make the effect of resonance of the coil 7 and the capacitor 8 more prominent, for the following reason, it is preferable to increase, as much as possible, the input current Iin at the time the boosting operation on the DC power supply circuit 3 is carried out. The energy source that causes resonance depends on the level of the input current Iin which is consumed in the DC power supply circuit 3 while the output voltage of the circuit 3 reaches the open voltage. Although increasing the input current Tin increases the degree of resonance, it is necessary to execute the boosting operation as quickly as the performance of the DC power supply circuit 3 allows.

Power supply to the ignition means 5 is accomplished by the following schemes.

(A) To use the output of the DC power supply circuit.

(B) To use the output of the DC-AC converter.

Figure 6:
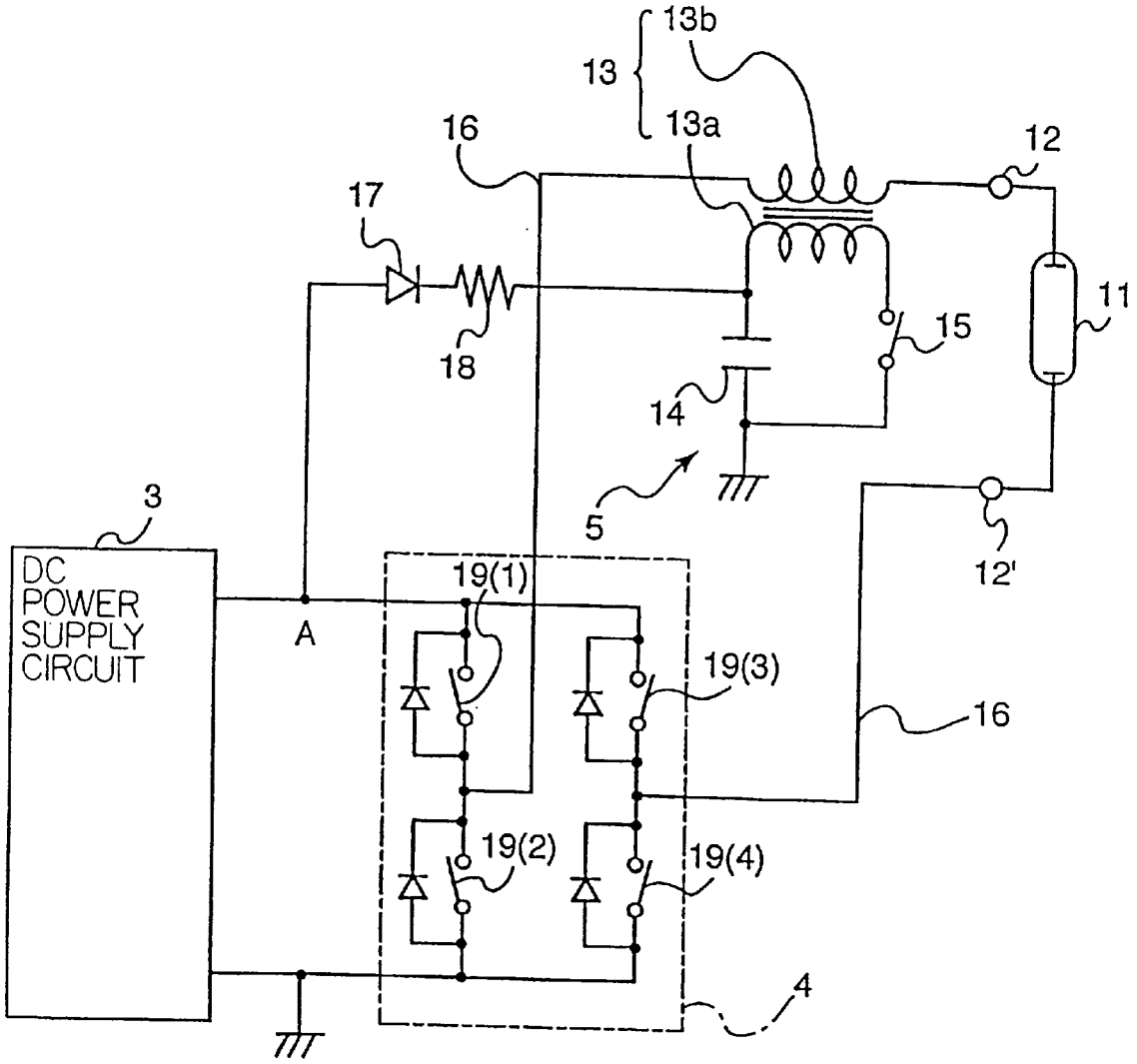
FIG. 6 is a circuit diagram depicting the essential portion of one example of the circuit constitution.

FIG. 6 shows one example of the scheme A, and depicts only the DC power supply circuit 3 and the circuit portion that is located at the subsequent stage of the circuit 3.

The ignition means 5 includes a pulse transformer 13, a capacitor 14 and a switch element 15, the pulse transformer 13 having a secondary winding 13*b* on a connection line 16 which connects one of the output terminals of the DC-AC converter 4 to an output terminal 12. The other output terminal of the DC-AC converter 4 is connected to an output terminal 12' by a connection line 16'.

The primary winding, 13*a,* of the pulse transformer 13 has one end connected to the capacitor 14 and the other end connected to the switch element 15, with a node between the capacitor 14 and switch element 15 being grounded.

The output voltage of the DC power supply circuit 3 is separated at a point A in the FIG. 6 to two, one sent to the input terminal of the DC-AC converter 4 while the other is sent to the capacitor 14 via a diode 17 and a resistor 18. When the capacitor 14 is charged and its terminal voltage reaches a predetermined value, the switch element 15 is switched on or conducts. At that time, the pulse that is generated on the primary winding 13*a* of the pulse transformer 13 is boosted, and the boosted pulse is superimposed on the output voltage of the DC-AC converter 4 on the secondary winding 13*b*. The resultant voltage is applied to the discharge lamp 11.

In this case, a discharging gap element may be used or a semiconductor element which is typified by a thyristor may be used as the switch element 15. The latter case is advantageous in that the timing at which a control circuit provided for the semiconductor element generates an ignition pulse can be defined more specifically.

The DC-AC converter 4 takes the constitution of, for example, a bridge type which has semiconductor switch elements 19(i) (i=1, 2, 3, 4) indicated by switch symbols in the diagram. The semiconductor switch elements 19(1) and 19(4), and the semiconductor switch elements 19(2) and 19(3) are paired with each other and switched reciprocally by a signal from an unillustrated drive control circuit.

Figure 7:
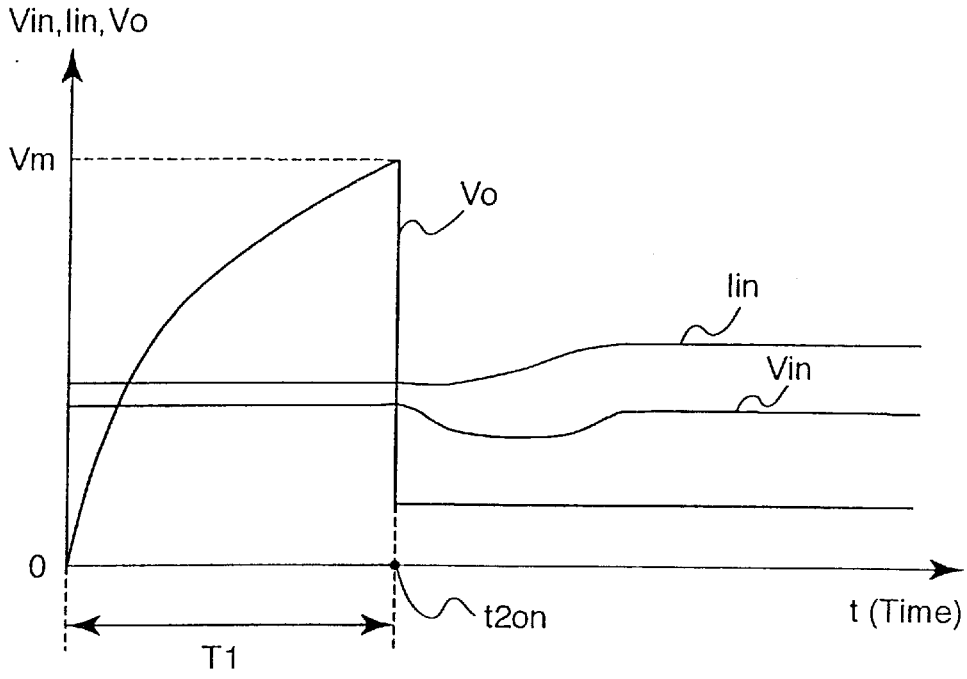
FIG. 7 is a schematic graph showing variations in input voltage and input current at the time a discharge lamp is lit when the output voltage of the DC power supply circuit reaches a predetermined value in the circuit of the FIG. 6.
Figure 8:
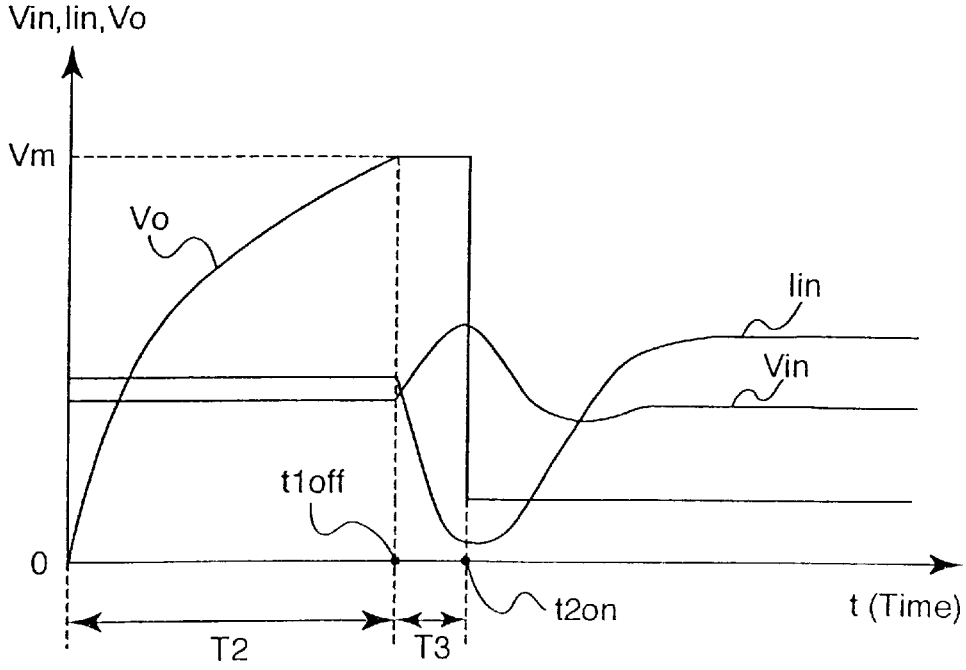
FIG. 8 is a schematic graph showing variations in input voltage and input current when a discharge lamp is lit after the output voltage of the DC power supply circuit reaches a predetermined value in the circuit of the FIG. 6.

FIGS. 7 and 8 schematically exemplify time-dependent variations in the input voltage Vin, the input current Iin and the output voltage of the DC power supply circuit 3 (Vo). FIG. 7 shows a case which matches with the advantage of (I), and FIG. 8 a case which matches with the advantage of (II).

FIG. 7 depicts the discharge lamp 11 being lit at the time (=t2on) when the output voltage Vo reaches the open voltage (Vm). The output voltage Vo rises with a given time constant in a period T1 where t≦t2on, and rapidly falls to become the lamp voltage of the discharge lamp 11 when t>t2on. Accordingly, the input current Iin gradually increases to asymptotically go to a constant value, while the input voltage Vin drops slightly but is restored thereafter.

The ignition pulse, which is generated as the switch element 15 is switched on or conducts, is applied to the discharge lamp 11 in the period T1, but will not be generated as Vo drops while t>t2on. Although FIG. 7 shows a case where the discharge lamp 11 is lit as Vo reaches Vm at the end of the period T1, when the discharge lamp 11 is lit before Vo=Vm, Vo rapidly drops since then to become equal to the lamp voltage of the discharge lamp In FIG. 8, it is a time t=t1off that the output voltage Vo reaches the open voltage Vm, and the discharge lamp 11 is lit at a time t=t2on. The output voltage Vo rises with a given time constant in a period T2 where t<t1off, Vo shows a given value Vm in a period T3 where t1off ≦t≦2on, and Vo rapidly falls to become the lamp voltage of the discharge lamp 11 when t>t2on. Accordingly, the input current Iin rises after temporary drop, and gradually goes to a constant value asymptotically. The input voltage Vin gets to a peak near t=t2on, and then goes back to the value that is acquired in the period T2.

The ignition pulse, which is generated as the switch element 15 is switched on or conducts, is applied to the discharge lamp 11 in the period T2 or T3, but will not be generated as Vo drops while t>t2on.

In this case, therefore, even after Vo=Vm, the discharge lamp 11 can be lit by applying the ignition pulse to the discharge lamp 11 until the voltage at the node between the coil 7 and the capacitor 8 reaches a peak.

Figure 9:
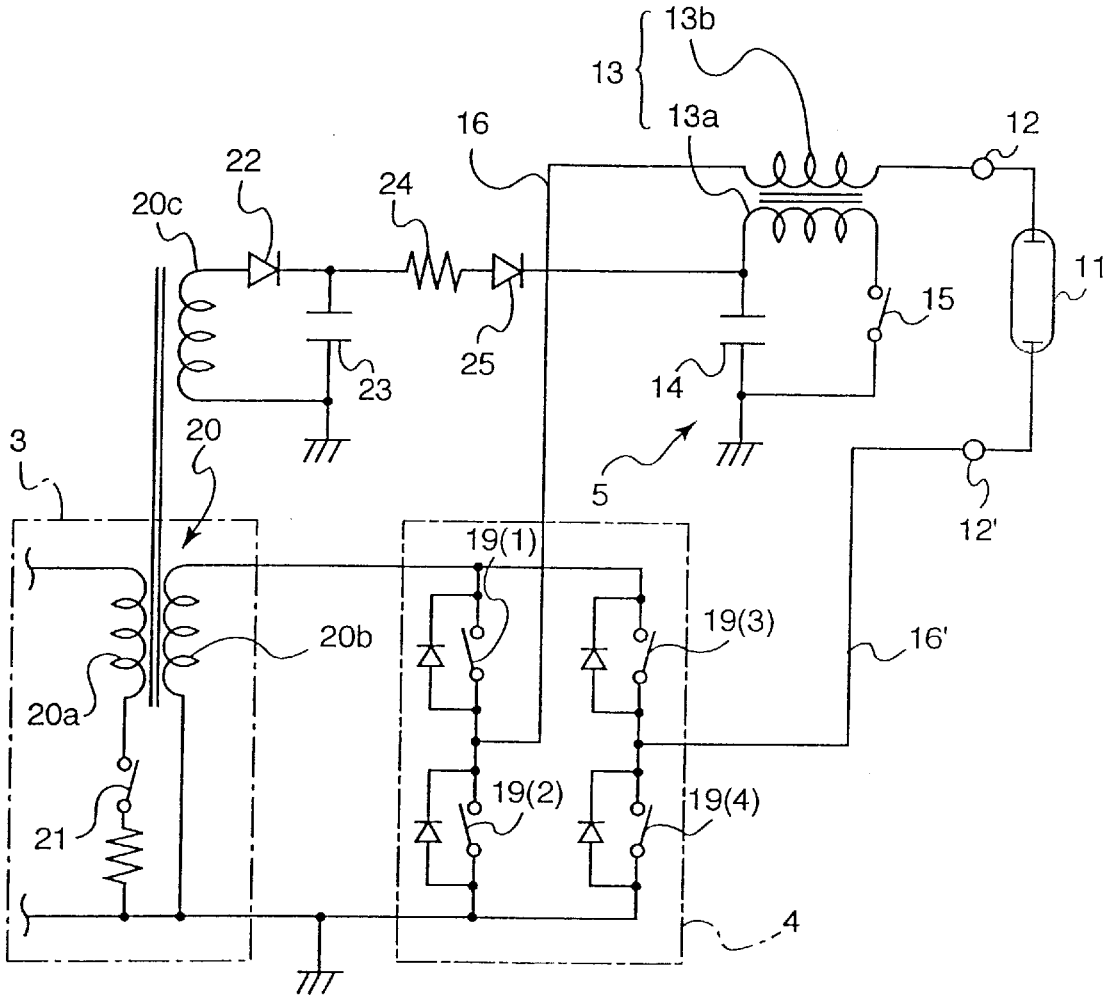
FIG. 9 is a circuit diagram depicting the essential portion of another example of the circuit constitution.

In the constitution illustrated in FIG. 6, the output voltage of the DC power supply circuit 3 is supplied as it is to the ignition means 5. Instead, as shown in FIG. 9, the output voltage may be acquired from the secondary winding of a transformer 20 in the DC power supply circuit 3, which is so designed that the switching action of a semiconductor switch element 21 provided at the primary side of the transformer 20 (indicated by a switch symbol in the diagram) is controlled by the control means 6, and the output voltage may then be supplied to the capacitor 14 of the ignition means 5. Specifically, the transformer 20 has two secondary windings 20*b* and 20*c* provided with respect to a primary winding 20*a*, the output voltage acquired from one secondary winding 20*b* is supplied to the DC-AC converter 4 at the subsequent stage while the output voltage acquired from the other secondary winding 20*c* is supplied via a resistor 24 and a diode 25 to the capacitor 14 after passing through a rectifier which comprises a diode 22 and a capacitor 23. The diode 22 has an anode connected to the second winding 20*c* of the transformer 20 and a cathode connected to the resistor 24 and also grounded via the capacitor 23. The constitution of the primary side of the pulse transformer 13 is the same as the one shown in FIG. 6.

Figure 10:
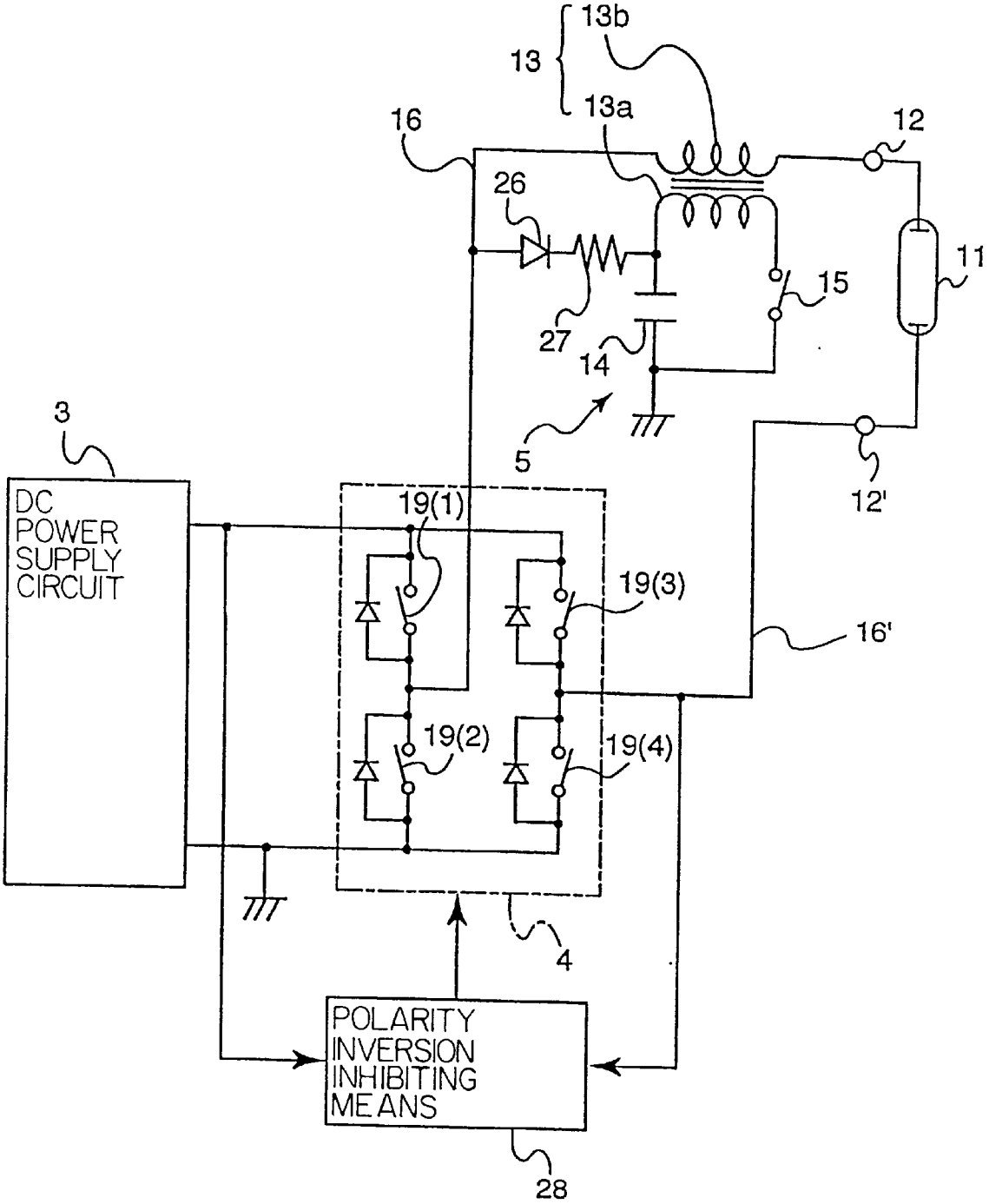
FIG. 10 is a circuit diagram depicting the essential portion of an example of the circuit that is so designed as to supply power to ignition means from DC-AC converter.

With regard to the scheme B, the output voltage of the DC-AC converter 4 may be supplied to the capacitor 14 of the ignition means 5 via a diode 26 and a resistor 27 as shown in FIG. 10. Note that the constitution of the primary side of the pulse transformer 13 is the same as the one shown in FIG. 6, and the anode of the diode 26 is connected to one of the two output terminals of the DC-AC converter 4.

Figure 11:
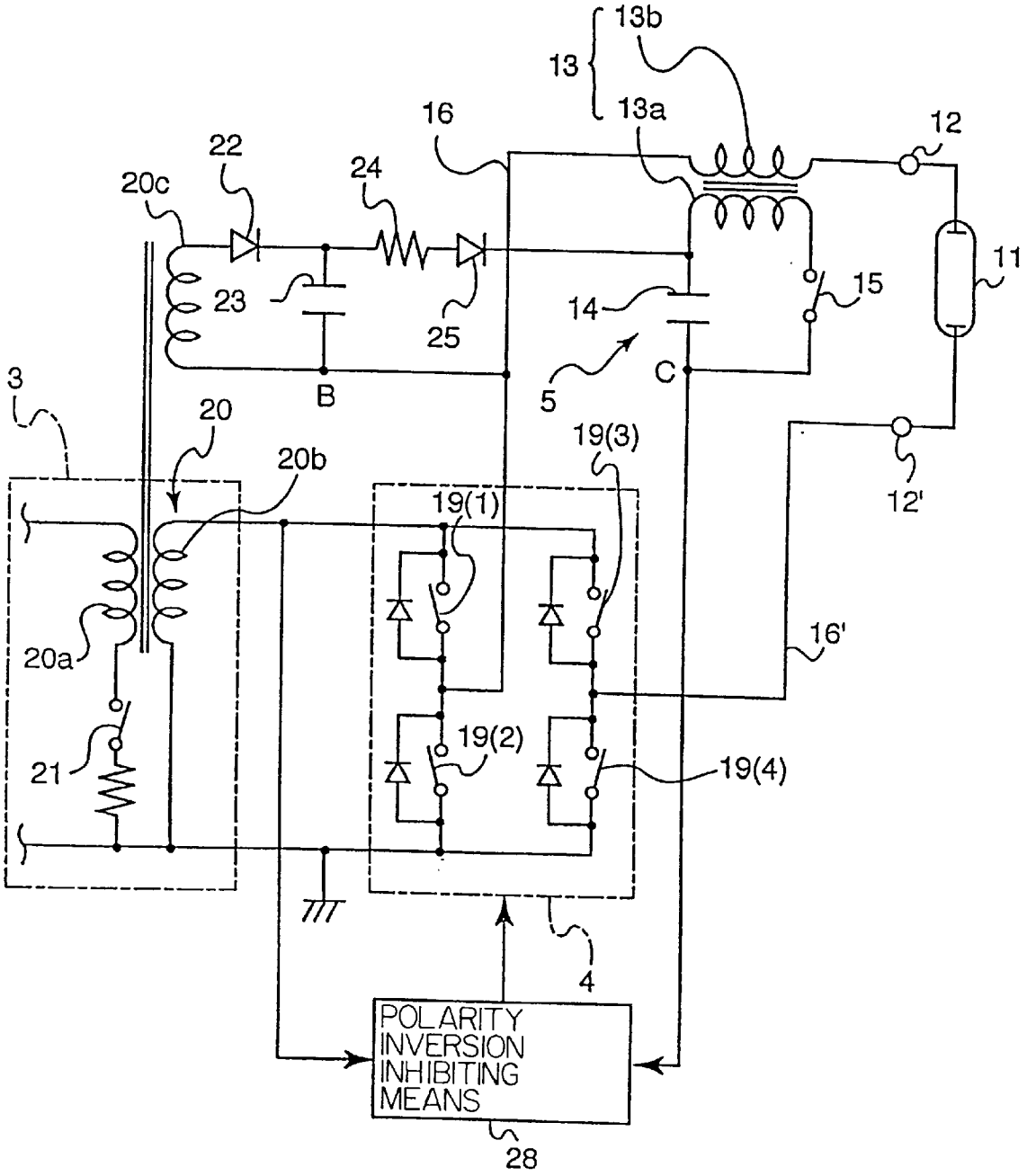
FIG. 11 is a circuit diagram depicting the essential portion of a further example of the circuit constitution.

As another modification, as shown in FIG. 11, a node B between the secondary winding 20c of the transformer 20, which constitutes the DC power supply circuit 3, and the capacitor 23 is connected to the connection line 16, and a node C between the capacitor 14, which constitutes the ignition means 5, and the switch element 15 is connected to the connection line 16'.

With the circuit constitution as shown in FIG. 10 or 11, the capacitor 14 of the ignition means 5 is charged only in a half-wave period in one period of an AC voltage (rectangular voltage) output from the DC-AC converter 4. Even when the output voltage of the DC power supply circuit 3 reaches the open voltage, therefore, the terminal voltage of the capacitor 14 may not become large enough to generate the ignition pulse.

This inconvenience can be avoided by inhibiting the inversion of the polarity of the output voltage of the DC-AC converter while the output voltage of the DC power supply circuit is being boosted to the open voltage.

Figure 12:
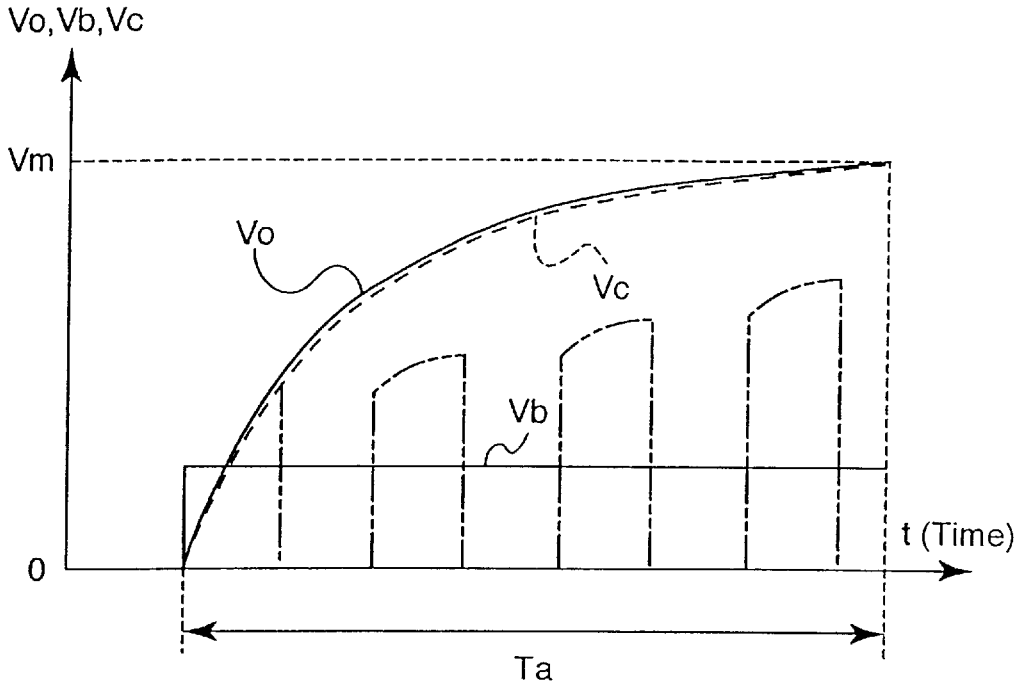
FIG. 12 is a schematic graph for explaining a rise in the charge voltage of a capacitor which is a constituent of the ignition means.

As shown in FIG. 12, the polarity of the output voltage of the DC-AC converter 4 (Vb) is fixed (to the positive polarity in the diagram) in a period Ta where the output voltage Vo of the DC power supply circuit 3 rises with a given time constant and reaches the open voltage Vm. This allows the terminal voltage of the capacitor 14 (Vc) to rise in responsive to Vo, so that the terminal voltage becomes high enough to generate the ignition pulse in the period Ta.

A graph line indicated by a two-dot chain line in the figure comparatively shows a time-dependent change in Vc when the inversion of the polarity of Vo is not inhibited.

Polarity inversion inhibiting means 28, which inhibits the inversion of the polarity of the output voltage Vb of the DC-AC converter 4 in the period Ta where the output voltage Vo of the DC power supply circuit 3 reaches to the predetermined voltage Vm in a loadless condition by the boosting operation of the DC power supply circuit 3, is provided to control the driving of the DC-AC converter 4. (Specifically, the semiconductor switch elements 19(1) and 19(4) are kept on, while the semiconductor switch elements 19(2) and 19(3) are kept off.) This control can ensure reliable generation of the ignition pulse. The period Ta can be checked based on acquisition of a detection signal of Vo or Vb.

When one wants to fix the polarity of Vo upon generation of the ignition pulse to a predetermined polarity, a thyristor should better be used as the switch element 15, one constituent of the ignition means 5. If a discharging gap element is used as the switch element 15, however, it is only the constitution in FIG. 11 that is allowable.

If a thyristor is used as the switch element 15, the thyristor may not be turned off by the holding current. To avoid such an inconvenience, one has to employ such control as to invert the polarity of the output voltage of the DC-AC converter before lighting the discharge lamp. In this case, the simple constitution in FIG. 10 suffices.

Figure 13:
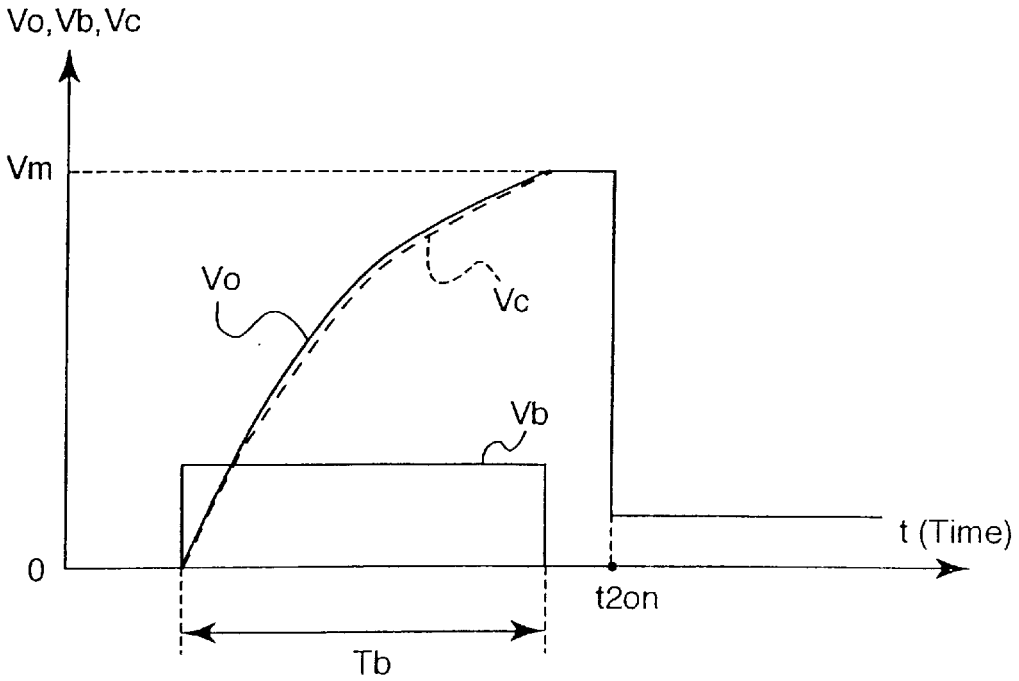
FIG. 13 is a schematic graph for explaining blocking of the holding current when a thyristor is used as a switch element in the ignition means.

This will be discussed below specifically. As shown in FIG. 13, the polarity of the output voltage Vb of the DC-AC converter 4 is fixed in a period Tb where the output voltage Vo of the DC power supply circuit 3 rises and reaches Vm, and the polarity of Vb is inverted earlier than the time of lighting the discharge lamp 11 that is indicated by t=t2on. As the holding current does not flow to the thyristor via the diode 26 and the resistor 27 from the DC-AC converter 4 when the discharge lamp 11 is lit in FIG. 10, the thyristor can be turned off after lighting the discharge lamp 11.

As apparent from the foregoing description, according to one aspect of this invention, the timing for applying the ignition pulse to a discharge lamp is specified and the resonance of the coil and capacitor, provided at the input stage of the DC power supply circuit, can suppress a drastic fall of the input voltage to the DC power supply circuit upon lighting of the discharge lamp. It is therefore possible to prevent deterioration of the lighting characteristic of a discharge lamp which would otherwise make it difficult to set the discharge lamp on. This can sufficiently reduce the frequency of occurrence of lighting failures of a discharge lamp.

According to another aspect of this invention, even after the output voltage of the DC power supply circuit reaches a predetermined value in a loadless condition, lighting of a discharge lamp can be implemented more surely by applying the ignition pulse to the discharge lamp to light the lamp while the voltage at the node between the coil and capacitor, provided at the input stage of the DC power supply circuit, reaches a peak.

Further, one modification of the invention which uses the polarity inversion inhibiting means can prevent such an inconvenience that even if the output voltage of the DC power supply circuit reaches a predetermined value in a loadless condition, the charge voltage of the capacitor of the ignition means does not get high enough to generate the ignition pulse. This can enhance the reliability of generating the ignition pulse.

It should be apparent to those skilled in the art that the present invention may be embodied in many other specific forms without departing from the spirit or scope of the invention. Therefore, the present examples and embodiment are to be considered as illustrative and not restrictive and the invention is not to be limited to the details given herein, but may be modified within the scope and equivalence of the appended claims.

What is claimed is:

1. A lighting circuit for a discharge lamp, comprising:

a DC power supply circuit having a coil and a capacitor at an input stage of said power supply circuit;

a DC-AC converter for converting an output voltage of said DC power supply circuit to an AC voltage and supplying said AC voltage to a discharge lamp;

ignition means for generating an ignition pulse to said discharge lamp; and control means for performing variable control on said output voltage of said DC power supply circuit in such a way as to carry out a boosting operation to boost said output voltage of said DC power supply circuit to a predetermined voltage under a loadless condition while said ignition pulse generated by said ignition means is supplied to said discharge lamp to thereby light said discharge lamp, whereby while said control means is performing said boosting operation on said DC power supply circuit, said ignition means applies said ignition pulse to said discharge lamp to light said discharge lamp.

2. The lighting circuit according to claim 1, further comprising polarity inversion inhibiting means for inhibiting inversion of a polarity of said output voltage of said DC-AC converter while said output voltage of said DC power supply circuit is allowed by said boosting operation to reach said predetermined voltage under a loadless condition; and wherein said ignition means has a switch element, a capacitor and a pulse transformer, whereby said capacitor of said ignition means is charged with said voltage from said DC power supply circuit or said DC-AC converter and when a terminal voltage of said capacitor reaches a predetermined value, said switch element operates to generate said ignition pulse and supply said ignition pulse to said discharge lamp.

3. The lighting circuit according to claim 2, wherein a timing for said ignition pulse is controlled by properly setting constants of circuit elements of said ignition means.

4. The lighting circuit according to claim 2, further comprising a timing controller for controlling a timing for said ignition means.

5. The lighting circuit according to claim 2, wherein said output voltage of said DC power supply circuit is supplied to said ignition means.

6. The lighting circuit according to claim 2, wherein an output voltage of said DC-AC converter is supplied to said ignition means.

7. The lighting circuit according to claim 2, wherein said switch element is a discharging gap element.

8. The lighting circuit according to claim 2, wherein said switch element is a semiconductor element.

9. The lighting circuit according to claim 1, wherein a timing for said ignition pulse is controlled by properly setting constants of circuit elements of said ignition means.

10. The lighting circuit according to claim 1, further comprising a timing controller for controlling a timing for said ignition means.

11. The lighting circuit according to claim 1, wherein said output voltage of said DC power supply circuit is supplied to said ignition means.

12. The lighting circuit according to claim 11, wherein said DC power supply circuit comprises a transformer having a primary winding and a secondary winding and an output voltage acquired from said secondary winding is supplied to said capacitor of said ignition means.

13. The lighting circuit according to claim 1, wherein an output voltage of said DC-AC converter is supplied to said ignition means.

14. The lighting circuit according to claim 13, wherein said output voltage of said DC-AC converter is supplied to said capacitor of said ignition means via a diode and a resistor.

15. A lighting circuit for a discharge lamp, comprising:

a DC power supply circuit having a coil and a capacitor at an input stage;

a DC-AC converter for converting an output voltage of said DC power supply circuit to an AC voltage and supplying said AC voltage to a discharge lamp;

ignition means for generating an ignition pulse to said discharge lamp; and control means for performing variable control on said output voltage of said DC power supply circuit in such a way as to carry out a boosting operation to boost said output voltage of said DC power supply circuit to a predetermined voltage under a loadless condition while said ignition pulse generated by said ignition means is supplied to said discharge lamp to thereby light said discharge lamp, whereby during a period from a point at which said coil and said capacitor provided at said input stage of said DC power supply circuit start resonating after execution of said boosting operation on said DC power supply circuit by said control means, to a point at which a voltage at a node between said coil and said capacitor reaches a peak, said ignition means applies said ignition pulse to said discharge lamp to light said discharge lamp.

16. The lighting circuit according to claim 15, further comprising polarity inversion inhibiting means for inhibiting inversion of a polarity of said output voltage of said DC-AC converter while said output voltage of said DC power supply circuit is allowed by said boosting operation to reach said predetermined voltage under a loadless condition; and wherein said ignition means has a switch element, a capacitor and a pulse transformer, whereby said capacitor of said ignition means is charged with said voltage from said DC power supply circuit or said DC-AC converter and when a terminal voltage of said capacitor reaches a predetermined value, said switch element operates to generate said ignition pulse and supply said ignition pulse to said discharge lamp.

17. The lighting circuit according to claim 15, wherein a timing for said ignition pulse is controlled by properly setting constants of circuit elements of said ignition means.

18. The lighting circuit according to claim 15, further comprising a timing controller for controlling a timing for said ignition means.

19. The lighting circuit according to claim 15, wherein said output voltage of said DC power supply circuit is supplied to said ignition means.

20. The lighting circuit according to claim 15, wherein an output voltage of said DC-AC converter is supplied to said ignition means.

21. A lighting circuit for a discharge lamp, comprising:

a DC power supply circuit having a coil and a capacitor at an input stage of said power supply circuit;

a DC-AC converter for converting an output voltage of said DC power supply circuit to an AC voltage and supplying said AC voltage to a discharge lamp; ignition means for generating an ignition pulse to said discharge lamp; and control means for performing variable control on said output voltage.

* * * * *